US005130215A

United States Patent [19]

Adley et al.

[11] Patent Number: 5,130,215

[45] Date of Patent: Jul. 14, 1992

[54] ELECTROPHOTOGRAPHIC PHOTOCONDUCTOR CONTAINS ORDERED COPOLYESTER POLYCARBONATE BINDER

[75] Inventors: James M. Adley, Mantorville, Minn.; Vernon M. Balthis, Boulder, Colo.; Dean S. Ehn, Boulder, Colo.; Ralph F. Fox, Boulder, Colo.; Jacob Pacansky, San Jose, Calif.; Robert L. Vollmer, Boulder, Colo.; Robert J. Waltman, Gilroy, Calif.

[73] Assignee: Lexmark International, Inc., Greenwich, Conn.

[21] Appl. No.: 590,094

[22] Filed: Sep. 28, 1990

Related U.S. Application Data

[63] Continuation-in-part of Ser. No. 401,263, Aug. 31, 1989.

[51] Int. Cl.[5] ..... G03G 5/05

[52] U.S. Cl. ..... 430/58; 430/96

[58] Field of Search ..... 430/58, 57, 96

[56] References Cited

U.S. PATENT DOCUMENTS

| | | | |
|---|---|---|---|
| 4,150,987 | 4/1979 | Anderson et al. | 430/58 |
| 4,390,610 | 6/1983 | Bowder et al. | 430/73 X |
| 4,391,888 | 7/1983 | Chang et al. | 430/57 |
| 4,737,414 | 4/1988 | Hirt et al. | 428/473.5 |

FOREIGN PATENT DOCUMENTS 0318943 7/1989 European Pat. Off. .

OTHER PUBLICATIONS

Patent Abstracts of Japan, vol. 9, No. 182 (P-376) (1905), Jul. 27, 1985, "Electrophotographic Sensitive Body and Its Manufacture".

Patent Abstracts of Japan, vol. 12, No. 151 (P-699) (2998), May 11, 1988, "Binder Resin for Electrophotographic Sensitive Body".

*Primary Examiner*—David Welsh

*Attorney, Agent, or Firm*—John A. Brady

[57] ABSTRACT

A layered electrophotographic photoconductor is disclosed having a ground plane layer, a charge generating layer carried by the ground plane layer, and a charge transport layer carried by the charge generating layer. The polymeric binder material of the charge transport layer and the charge generation layer comprises an ordered copolyestercarbonate whose ester content is in the range of about 35 wt. % to about 70 wt. %, of which about 60 wt. % to about 70 wt. % is preferred, and of which about 70 wt. % is the most preferred. The charge generating molecule is a squarylium, and more specifically 2,4-bis-(4-dimethylamino-2-hydroxyphenyl) cyclobutene diylium-1,3-diolate (OHSQ), or an operative phthalocyanine compound, and preferably oxytitanium phthalocyanine. The charge transporting molecule is a hydrazone, and more specifically 4-diethylaminobenzaldehyde-1,1-diphenylhydrazone (DEH), or 4-diphenylaminobenzaldehyde-1,1-diphenylhydrazone (TPH).

40 Claims, 4 Drawing Sheets

| 1 | 2 | 3 | 4 | 5 | 6 | 7 | 8 |
|---|---|---|---|---|---|---|---|
| | | INITIAL | | ROOM LIGHT FATIGUE | | 40 K CYCLES | |
| SAMPLE | % ESTER | CHARGE | DISCHARGE | CHARGE | DISCHARGE | CHARGE | DISCHARGE |
| A | 0 | 677 | 121 | 666 | 230 | 653 | 396 |
| B | 36 | 678 | 132 | 654 | 98 | 625 | 237 |
| C | 46 | 670 | 167 | 656 | 144 | 623 | 276 |
| D | 63 | 672 | 109 | 650 | 44 | 619 | 213 |
| E | 69 | 669 | 104 | 646 | 36 | 604 | 179 |
| F | 87 | 665 | 152 | 639 | 85 | 621 | 245 |
| G | 100 | 584 | 59 | 448 | 40 | 347 | 100 |

FIG. 6.

ELECTROPHOTOGRAPHIC PHOTOCONDUCTOR CONTAINS ORDERED COPOLYESTER POLYCARBONATE BINDER

RELATED PATENT APPLICATION

This application is a continuation in part of copending and commonly assigned patent application Ser. No. 07/401,263, filed 8/31/89, and entitled Electrophotographic Photoconductor.

FIELD OF THE INVENTION

This invention relates to the field of electrophotography, and more specifically to photoconductors for use in electrophotographic reproduction devices.

BACKGROUND OF THE INVENTION

The present invention relates to layered electrophotographic photoconductors; i.e., photoconductors having a metal ground plane member on which a charge generation layer (CGL) and a charge transport layer (CTL) are coated, in that order. Such a photoconductor may optionally include a barrier layer located between the metal layer and the CGL, and/or an adhesion promoting subbing layer located intermediate the barrier layer and the CGL, and/or an overcoat layer on the top surface of the CTL. In photoconductors of this type, the charge generation function and the charge transport function are provided by different discrete layers that are coated at different times during manufacture of the photoconductor.

As used herein, the terms dark charge and charge voltage are intended to mean the state of a photoconductor area that has been charged, but has not been exposed to light. The terms light charge and discharge voltage are intended to mean the state of a photoconductor area that has been charged and has been subsequently exposed to light.

In use, such a photoconductor is maintained in the dark as it is charged at the charging station of a reproduction device. The photoconductor must accept a high magnitude electrical charge on its outer surface at this charging station; i.e., by the use of a charge corona. This initial charge, which is defined as the dark charge, must not appreciably decrease in magnitude with time (i.e., dark decay), and the high magnitude of this initial charge must be repeatable with extended photoconductor usage or cycling.

The photoconductor's dark charge is reduced to what is defined as the white charge by image-forming radiation that strikes the photoconductor at the imaging station of the reproduction device. This white charge must be of a relatively low magnitude, and this low magnitude also must be repeatable with extended photoconductor usage or cycling.

During use in a reproduction device, the photoconductor is usually subjected to an erase source of radiation one time during each reproduction cycle. This radiation is usually of a spectral nature that can be characterized as yellow light. In addition, initial manufacture of the photoconductor and/or the reproduction device, and later servicing of the reproduction device and the like, periodically causes the photoconductor to be exposed to ambient room light. Room light can be characterized a white light, composed primarily of yellow and blue light. Room light is sometimes called blue light herein.

An acceptable photoconductor must maintain its electrical characteristics, such as dark charge and white charge, for example, after being exposed to these yellow and blue light sources (i.e., the photoconductor must not appreciably fatigue as a result of these radiation sources).

The CGL of such photoconductors usually comprises a polymeric binder containing a charge generation molecule, whereas the overlying CTL comprises a polymeric binder containing a charge transport molecule.

The charge generation molecules within the CGL are sensitive to image-forming radiation, and photo generate free electron-hole pairs within the CGL as a result of such radiation. If the surface of the photoconductor has been charged negatively, the electrons of the electron-hole pairs migrate to the photoconductor's ground plane as the holes migrate through the CTL to the charged surface of the photoconductor. In this way, the surface of the photoconductor is discharged to the white charge level, and a latent image is formed on the surface of the photoconductor.

The CTL is usually non-absorbent of the image-forming radiation, and its charge transport molecules serve the purpose of transporting holes to the surface of the photoconductor to neutralize the charge on this surface.

One of the parameters limiting the performance of a photoconductor is the charge carrier mobility of the CTL. High mobility of radiation generated charge carriers is desirable to thereby provide substantial discharge of the photoconductor in its white voltage or charge area, and the magnitude of this low charge state should not vary appreciably with photoconductor usage.

The photoconductor in its non-radiated areas must maintain its initial dark charge or voltage, and the magnitude of this high charge state should not vary appreciably with photoconductor usage.

In addition, since the CTL is usually exposed to mechanical wear (i.e., a developer station, a transfer station, and the like) the polymer of the CTL is desirably a wear-resistant polymer.

Prior art electrophotographic photoconductors have used polyester polymers and polycarbonate polymers as binders for the CTL and/or the CGL of the photoconductor. The prior art has also used mixtures of polycarbonate and polyester as binders for these layers, as well as copolymers thereof.

We have discovered that the use of an ordered copolyestercarbonate polymer (whose molecular structure is represented in FIG. 4) as the binder of the photoconductor's CGL and/or CTL provides a superior photoconductor. The ordered copolyestercarbonate polymer in accordance with the invention must have a critical range of ester content, as will be described. As a result, a photoconductor in accordance with the invention has electrical characteristics that do not appreciably change upon being subjected to yellow and/or blue light, and the photoconductor possesses good mechanical wear properties.

U.S. Pat. No. 4,330,662, which is incorporated herein by reference, describes an ordered copolyestercarbonate of the type used as a binder in accordance with the present invention. The polymeric material described in this patent is said to have superior heat resistance, clarity and impact strength, and is said to be useful for making tough transparent films.

As used herein, the term ordered copolyestercarbonate is intended to mean the material described in U.S. Pat. No. 4,330,662 and sold by the Dow Chemical Company as the brand Calibre (XP 734). The ordered molecular structure of this material is represented in FIG. 4.

An ordered copolyestercarbonate material of the type described in above-mentioned U.S. Pat. No. 4,330,662, and having a critical range of ester content in accordance with the present invention, when used as the binder for the CTL and/or the CGL of a layer photoconductor, provides a superior electrophotographic photoconductor, as will be described.

U.S. Pat. No. 4,621,038 is of interest in that it describes a layered photoconductor, and suggests that the CGL include fluorinated squaraine compounds as the photo generation molecule, and lists a number of binder polymers that may be used in the photoconductor layers, including polycarbonates, polyesters, as well as block random or alternating copolymers thereof.

U.S. Pat. No. 4,612,271 is of interest in that it teaches a photosensitive composition comprising azo compounds that can be used in optical disks and as an electrophotographic photosensitive material and suggests that, as a binder, a high molecular weight polymer may be used. A number of polymers are listed, including polyestercarbonate.

The charge generation molecule of the present invention is squarylium and preferably 2,4-bis-(4-dimethylamino-2-hyroxyphenyl) cyclobutene diylium-1,3-diolate (hereinafter referred to as OHSQ).

In this regard, U.S. Pat. No. 3,824,099, incorporated herein by reference, is of interest in that example 11 of the patent discloses the OHSQ molecule used in the present invention. This patent states that polyesters are suitable binders. The use of polycarbonate is also described.

The charge transport molecule of the present invention is a hydrazone and preferably 4-diethylaminobenzaldehyde-1,1-diphenylhydrazone (DEH).

In this regard, U.S. Pat. No. 4,150,987, incorporated herein by reference, is of interest in that this patent describes the use of a hydrazone in the CTL of a photoconductor. This patent suggests that a mixture of polyester resin and polycarbonate resin be used as a binder for the CTL.

This later patent is also of interest in that it describes the use of tetrahyrdofuran (THF) and toluene solvents to form the coating ink, these solvents also being preferred solvents of the present invention.

The prior art of which the present inventors are aware does not teach the invention's critical range of ester content for an ordered copolyestercarbonate CGL and/or CTL binder, nor the new and unusual results that flow from the use of the critical range(s) of the present invention.

SUMMARY OF THE INVENTION

The present invention deals with and improves the electrical characteristics of electrophotographic photoconductors in that these characteristics do not change with usage, or at least such changes are minimized. Exemplary photoconductor electrical characteristics are dark voltage and light, or white, voltage.

In use in an electrophotographic reproduction device, the photoconductor is uniformly surface charged to a high voltage, such as negative 800 volts DC, by the use of a charge corona at a charging station. The voltage to which the photoconductor is charged (i.e., its charge acceptance) is defined as the dark voltage.

The photoconductor is maintained in the dark during reproduction usage, and is selectively discharged as the photoconductor passes through an imaging station. The discharged areas of the photoconductor are thereafter at an exemplary voltage level of about −50 volts. In this way, the imaging station forms a latent image on the photoconductor. This image is subsequently toned, and its toner image is transferred to a sheet of substrate material, such as paper, as a copy or print is produced by the device. The voltage to which the photoconductor is discharged by the imaging station is defined as the light voltage.

These two photoconductor voltage characteristics may undesirably change with usage; that is, the photoconductor may not accept a full −800 volt charge at the charging station, and/or may not discharge to the low −50 volts at the imaging station after extended usage of the photoconductor, such as, for example, 50,000 or so reproduction cycles. In addition, servicing of the reproduction device many times exposes the photoconductor to ambient room light which may result in a change in the dark voltage and/or light voltage characteristic of the photoconductor.

An object of the invention is to eliminate or reduce the change in these and other electrical characteristics of an electrophotographic photoconductor that may occur with reproduction usage and/or room light exposure.

Another object of the invention is to provide an electrophotographic photoconductor having reduced discharged area fatigue, such as may be caused by the erase lamps of a reproduction device, and reduced fatigue upon exposure to room light.

A further object of the invention is to provide a layered electrophotographic photoconductor having a charge generating layer and a charge transport layer carried by the charge generating layer, wherein the binder polymeric material of the charge transport layer and the charge generation layer comprises an ordered copolyestercarbonate whose ester content is in the critical range of about 35 wt. % to about 70 wt. %. Within this range, an ester content of about 60 to 70 wt. % is preferred, and about 70 wt. % is the most preferred.

As a feature of the invention, a photoconductor in accordance with the invention, comprises a ground plane member, a charge generating layer carried by the ground plane member which includes a material capable of generating hole/electron pairs in the presence of activating light, and a charge transport layer carried by the charge generating layer which includes a material capable of transporting holes from the charge generating layer to the exposed surface of the charge transport layer, one or both of the layers including a polymeric binder material comprising an ordered copolyestercarbonate whose ester content is in the range of about 35 to 70 wt. %. Within this range, an ester content of about 60 to 70 wt. % is preferred, and an ester content of about 70 wt. % is the most preferred.

As a feature of the invention, the charge transport material is a hydrazone, and/or the charge generation material is a squarylium.

As a feature of the invention the charge transport material is 4-diphenylaminobenzaldehyde-1,1-diphenylhydrazone herein defined as TPH, and/or the charge generation material is an operative phthalocyanine, and preferably an oxytitanium phthalocyanine.

As a further feature of the invention, the method of making the photoconductor includes the use of non-amine solvents to form an OHSQ dispersion for use in coating the charge generation layer, and for forming a 4-diethylaminobenzaldehyde-1,1-diphenylhydrazone (DEH) solution for use in coating the charge transport layer.

When the ordered copolyestercarbonate is used in both the CGL and the CTL of the photoconductor, the CGL may be dispersion coated in the absence of amine solvents, and the CTL may be solution coated. Yet, the resulting photoconductor is found to have the desirable properties of prior art coated photoconductors using amine solvents and, in addition, dark fatigue and white fatigue are minimized.

These and other objects and advantages of the invention will be apparent to those of skill in the art upon reference to the following detailed description of the invention.

BRIEF DESCRIPTION OF THE DRAWING

FIG. 6 is a table showing the room light fatigue and the cycling fatigue that occur in photoconductor samples A–G, samples E and F of which are the preferred samples in accordance with the invention.

DETAILED DESCRIPTION OF THE INVENTION

Figure 1:
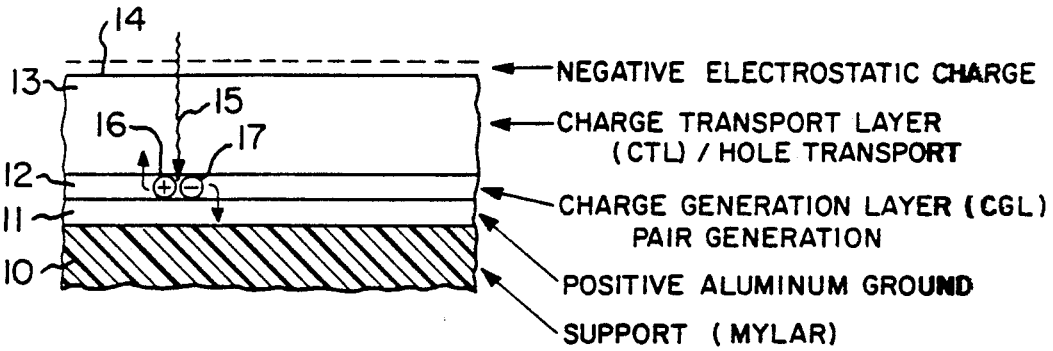
FIG. 1 is a schematic view of a layered photoconductor in accordance with the invention.

FIG. 1 is a schematic view of a layered photoconductor in accordance with the invention. The invention will be described in relation to a flexible web or belt photoconductor, and in relation to a drum photoconductor. However, it is to be understood that the invention finds equal utility in other forms. Photoconductors of the invention find utility in electrophotograhic reproduction devices, such as copiers and printers, and may be generally characterized as layered photoconductors wherein one layer (the CGL) absorbs light and, as a result thereof, generates electrical charge carriers, whereas a second overlying layer (the CTL) transports these charge carriers to the exposed surface of the photoconductor.

In the photoconductor of FIG. 1, a flexible substrate 10 (i.e., polyethelene terephthalate of the Mylar brand) is uniformly coated with a thin, uniform thickness layer of metallic aluminum 11. Aluminum layer 11 functions as an electrical ground plane.

Aluminum layer 11 is then coated with a thin, uniform thickness, charge generation layer (CGL) 12 comprising polymeric binder(s) and photosensitive molecules; i.e., an organic dye(s).

Finally, a uniform thickness charge transport layer (CTL) 13 is coated onto CGL 12. Typically, CTL 13 comprises a polymeric binder that contains a charge transport molecule(s).

The thickness of the various layers shown in FIG. 1 is not critical, and is well known to those of skill in the art. In an exemplary photoconductor, ground plane layer 11 was about 0.01 micron thick, CGL 12 was about 0.1 micron thick, and CTL 13 was in the range of about 15 to 22 microns thick. When a barrier layer was used intermediate layers 11 and 12, this layer was also about 0.1 micron thick.

While the details of composition of the coating inks that are used to form the CGL and the CTL of the present invention are not critical, a typical coating ink for the CGL may be made as follows. Seventeen grams of the ordered copolyestercarbonate and an optional 0.4 grams of dispersing agent are dissolved in 86 grams of THF solvent. This solvent and 8.8 grams of OHSQ are placed in a jar that has been half filled with relatively small steel balls. The jar is then placed on a paint shaker for about 2 hours. The resulting dispersion is then diluted with 249 grams of THF to form the final CGL coating ink. This ink is stable for a relatively long time, and may be used with a variety of coating equipment to form the CGL.

A typical coating ink for the CTL may be made as follows. Sixty grams of the ordered copolyestercarbonate, 40 grams of DEH, and optionally 2 drops of a silicone oil leveling agent, the brand DC-200, are dissolved in 500 grams of THF solvent. After adequate mixing, the resulting solution comprises the final CTL coating ink. This ink is also stable for relatively long time periods, and may be used with a variety of coating equipment to form the CTL.

In operation within a reproduction device, a charge corona is used to deposit a continuous layer of electrical charge onto the exposed surface 14 of CTL 13. For example, a negative charge of about 800 volts is applied to exposed surface 14.

As a feature of the present invention, the CTL includes a hydrazone that renders the photoconductor resistant to degradation due to effects of the charge corona at the reproduction device's charging station.

While different charge sources can be used at the charging station when the charging means is a negative corona, it has been sometimes observed that nitrogen oxide species are produced by the corona. These species tend to be absorbed by the solid surface of the adjacent moving photoconductor. The effect on reproduction quality is that of lower image density, also called image wash-out.

We have observed that the hydrazone molecule 2-methyl-4-diethylaminobenzaldehyde,1,1-diphenylhydrazone, when used as the transport molecule of a photoconductor CTL whose binder is ordered copolyestercarbonate in accordance with the invention, provides excellent copy/print quality in reproduction devices having a negative charge corona.

In the dual layer electrophotographic photoconductors of this invention, wherein one or both of the CGL and CTL include a binder comprising an ordered copolyestercarbonate having the critical ester content of the present invention, the CGL may to good advantage contain an operative charge transport compound comprising phthalocyanine, and more specifically an oxytitanium phthalocyanine charge generation compound. It has been found that a phthalocyanine charge transport compound is easy to disperse when formulating the coating ink from which the CTL of the present invention will be coated.

U.S. Pat. No. 4,725,519 suggests the use of titanium phthalocyanine in a CGL, but not in combination with the ordered copolyestercarbonate carbonate binder of the present invention.

Methods for producing oxytitanium phthalocyanine molecules are described in U.S. Pat. Nos. 4,664,997 and 4,777,251.

In the dual layer electrophotographic photoconductors of this invention, wherein one or both of the CGL and CTL includes a binder comprising an ordered copolyestercarbonate having the stated critical ester content, the CTL may to good advantage contain a TPH charge transport compound. Unexpectedly it has been found that the combination of this TPH transport molecule and this ordered copolyestercarbonate binder produces a photoconductor having a low rate of charge leakage (i.e. a high white voltage or dark charge).

U.S. Pat. No. 4,403,025 suggests the use of TPH in a CTL, but not in combination with the ordered copolyestercarbonate carbonate binder of the present invention.

Arrow 15 of FIG. 1 depicts the manner in which image-forming light exposure produces a hole-electron pair 16,17 within CGL 12. The negative member 17 of this pair is attracted to positive polarity ground plane 11, whereas the positive member 16 of this pair migrates through CTL 13 to the negative polarity exposed surface 14 of the photoconductor, thereby selectively discharging surface 14 in the image pattern of the light image exposure that is provided by the reproduction device (not shown).

In accordance with the invention, other well known features may be provided for the photoconductor of FIG. 1 (i.e., the use of an overcoat on surface 14, and/or the use of a barrier layer intermediate ground plane 11 and CGL 12, and/or the use of an adhesion-promoting subbing layer immediately under CGL 12).

As a feature of added utility, it is desirable that CGL 12 contain a molecule that is sensitive to the relatively inexpensive and reliable gallium arsenide (GaAs) lasers that are used in electrophotograhic printers. In this regard, squarylium dyes are of interest since they are sensitive to the near infrared radiation spectrum.

In accordance with one feature of the invention, CGL 12 is formed in a coating process that uses a coating medium or ink having a relatively insoluble, high purity, Ames negative, OHSQ dye pigment dispersed in a polymer matrix, in the absence of amine solvents, thus forming a fine particle dispersion of substantial viscosity. Innocuous solvents, such as tetrahydrofuran (THF), methylene chloride or toluene are used to solubilize the polymer matrix. This ink is then coated onto aluminum layer 11, to form CGL 12. Due to the relatively high viscosity of the ink, the coating process is simplified.

Once formed (i.e., the solvent is driven off by a curing or a drying process), dispersed CGL 12 provides a higher resistance to solvents that are thereafter used to coat CTL 13 than would exist had CGL 12 been produced from a coating solution containing amine solvents.

Figure 4:
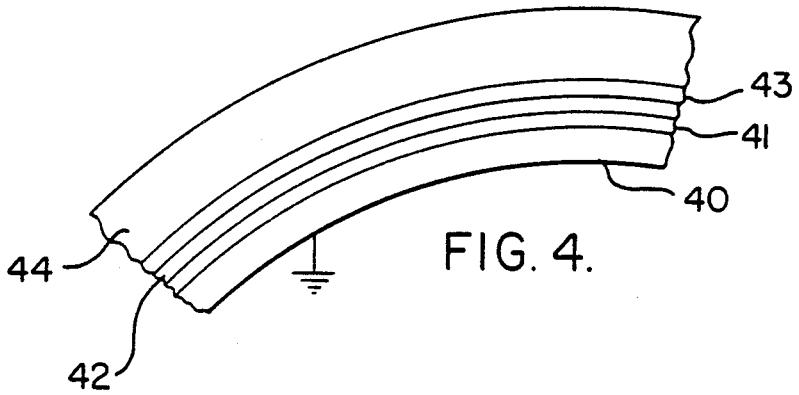
FIG. 4 discloses an embodiment of the invention in the configuration of a drum photoconductor.

CGL 12 is formed using ordered copolyestercarbonate as a binder. FIG. 4 represents the molecular structure of this polymer. A preferred manner of preparing the ink dispersion from which CGL 12 is coated comprised the use of a shaker mill having steel balls therein. A formulation of ordered copolyestercarbonate and THF solvent was warmed to effect complete solubility of the polymer in the solvent. The resulting solution and a quantity of OHSQ dye were then placed in the shaker mill. The shaker mill was then placed in a paint shaker.

After thorough mixing, the resulting dispersion was cooled and then diluted with additional THF solvent. Sand mill equipment is considered to be an alternative to the use of a shaker mill and paint shaker.

The resulting dispersion of OHSQ in the solvent-/polymer solution was then used to coat CGL 12. This dispersion is of a high viscosity and, as a result, the coating process is simplified.

When the above-mentioned ordered copolyestercarbonate is used as a binder or polymeric matrix in CTL 13 that contains a hydrazone transport molecule, such as DEH, the CTL experiences a significant increase in room light resistance (i.e, significantly less room light fatigue is experienced). In addition, less fatigue is experienced as a result of the reproduction device's yellow erase lights. Room or white light is considered to be a composed of blue light in the 400 to 480 nano meter (nm) wavelength range and of yellow light in the wavelength above 520 nm.

In accordance with the invention, the above-mentioned CGL and/or CTL include a polymeric binder material comprising an ordered copolyestercarbonate (whose molecular structure is represented in FIG. 4) whose ester content is in the range of about 35 to 70 wt. %, and is preferably in the range of about 60 wt. % to about 70 wt. %. Within this range, an ester content of about 70 wt. % is the most preferred.

When CTL 13 is not covered by an overcoat layer, and usage of such a layer is usually optional, the wear properties of CTL 13 must be considered. Use of the ordered copolyestercarbonate of the invention also provides outstanding wear characteristics to the photoconductor.

It is believed that room light fatigue of CTL 13 results in part from blue light absorption and in part from yellow light absorption, and that a resulting photochemistry occurs in layer 13. This photochemistry is believed to be the principle cause of the layer's dark voltage drop, the layer's increased dark decay rate, and the layer's white voltage evolution. A major participant in these undesirable effects is believed to be the blue light fatigue of the transport molecule DEH, which molecule likely photocyclizes to an indazole derivative in the presence of blue light and air ($O_2$) It is believed that this indazole derivative forms insulating layers within the CTL, thus interfering with the charge transport function of the CTL; i.e., transport of charge carries (for example, holes) from an underlying CGL to the surface of the CTL is inhibited.

We have found that this photochemical conversion to the indazole derivative is inhibited by the use of a critical range of ester content within the CTL's ordered copolyestercarbonate binder. As a result, it is not necessary to alter the structure of the DEH molecule, or the transport characteristics of this molecule.

As will be apparent, too high a polyester content in the ordered copolyestercarbonate causes deleterious effects on the electrical properties of the photoconductor, whereas too little polyester content fails to inhibit formation of the indazole derivative.

In accordance with a feature of the invention, CTL 13 is formed in a coating process that uses a coating medium or ink having DEH dispersed in a polymer matrix, thus forming a solution. Innocuous solvents, such as tetrahydrofuran (THF) or methylene chloride, are used to solubilize the polymer matrix. This ink is then coated onto CGL 12. Thereafter, the solvent is driven off by use of a curing or a drying process to thereby form the operable CTL.

Figure 2:
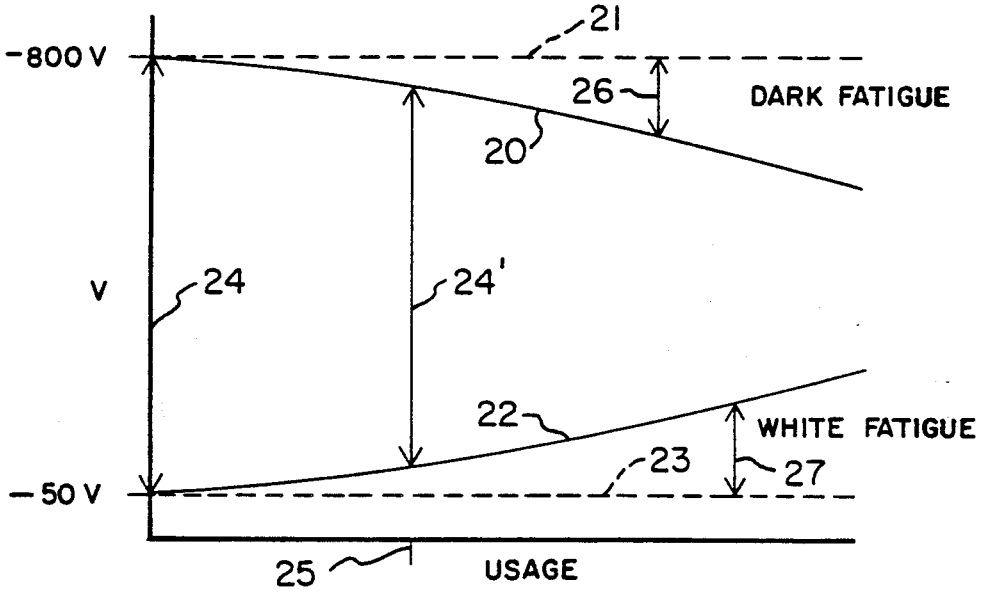
FIG. 2 is a graph showing the dark fatigue and the light fatigue that may occur with extended reproduction usage of the photoconductor of FIG. 1.

FIG. 2 is useful in explaining the new and unusual advantages and utility of the present invention. This figure shows the manner in which the photoconductor's dark charge voltage 20 may change with extended photoconductor usage, as compared to an ideal situation 21, and the manner in which the photoconductor's white discharge voltage 22 may change with extended photoconductor usage, as compared to an ideal situation 23. The rise in photoconductor discharge voltage that occurs with usage, as shown by 22, is sometimes called white evolution.

As shown on the FIG. 2 y-axis, the photoconductor initially accepts an 800 volt charge as the photoconductor passes through the reproduction device's charging station (not shown). As this fully-charged photoconductor then passes through the imaging station (not shown), the charge on selected areas of the photoconductor is reduced to 50 volts, whereas the remainder of the photoconductor retains its 800 volt charge.

This charge/image operation is shown by discharge curve 30 of FIG. 3, where time t1 represents the time at which a photoconductor area passes through the charging station, time t2 represents the same photoconductor area subsequently passing through the imaging station, time t3 represents the photoconductor area passing through a developing station (not shown) whereat toner deposits on the photoconductor's latent image, and time t4 represent the photoconductor area passing through a yellow light erase station (not shown). The time span between t1 and t2, for example, is usually only a fraction of a second.

Figure 3:
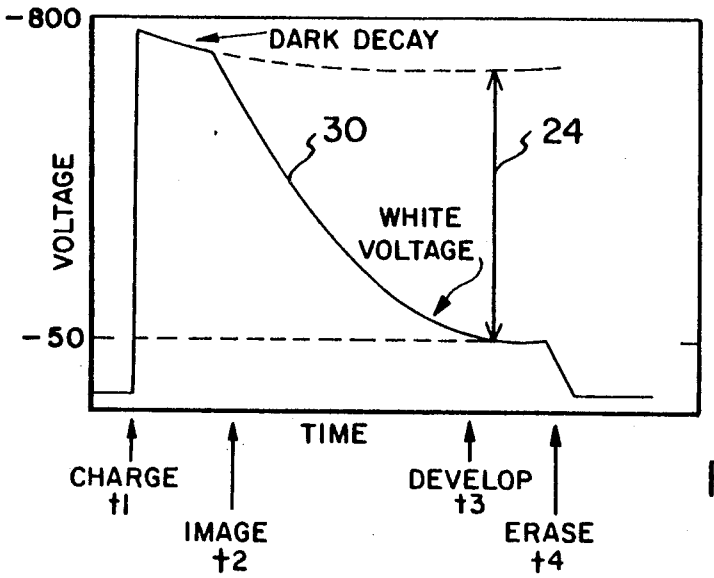
FIG. 3 is a graph showing the charging of the photoconductor of FIG. 1 at a charging station, the subsequent discharging of the photoconductor at an imaging station, the developing of the photoconductor's latent image at a developer station, and finally the erasing of the photoconductor at an erase station.
Figure 5:
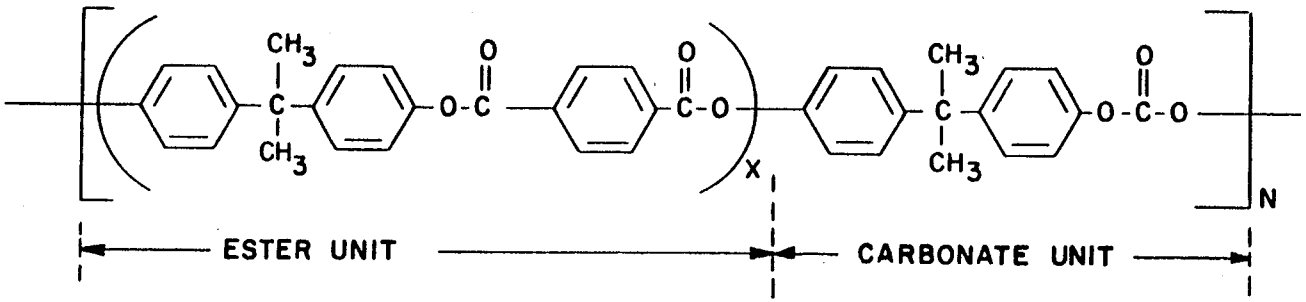
FIG. 5 is a drawing representing the molecular structure of the ordered or repeating unit copolyestercarbonate used in the invention.

Vector 24 of FIGS. 2 and 3 is the development vector (i.e., it is the voltage difference between the image/non-image areas of the photoconductor that cause toner to selectively deposit on only the photoconductor's latent image as the photoconductor passes through the developing station).

After extended usage of the photoconductor, which usage is usually measured in thousands of reproduction cycles, the photoconductor may experience fatigue, as is shown by 20 and 22 of FIG. 2. Thus, after usage 25 has been experienced, the development vector has reduced in magnitude to that shown at 24', and the discharge curve 30 of FIG. 3 has accordingly changed. The effect of usage fatigue is represented by arrows 26 and 27, where arrow 26 is dark fatigue and arrow 27 is white fatigue.

The effect of room light on the photoconductor of the invention is of a transient nature; i.e., any shift in the photoconductor's development vector that may occur as a result of room light exposure is restored by keeping the photoconductor in the dark after the period of exposure to room light. This phenomenon is most often experienced during manufacture of the photoconductor and/or the reproduction device, and can later on be experienced when the reproduction device covers are opened, as during servicing and the like. This effect predominately appears as an essentially step function downward shift in curves 20 and 22.

FIG. 4 discloses an embodiment of the invention in the configuration of a drum photoconductor. In this embodiment of the invention, an aluminum drum, a portion of which is shown at 40, is first coated with a polyamide barrier layer 41. This barrier layer is next coated with a subbing layer 42 comprising a polymer that promotes coating adhesion of CGL 43. Subbing layer 42 may comprise the ordered copolyestercarbonate above described.

This procedure forms the ground plane means 40–42 that next receives the squarylium-containing, dispersion-coated CGL 43, as above described. The top-exposed surface of the drum photoconductor comprises hydrazone containing solution-coated CTL 44, as above described.

The CGL of the present invention is of added utility when drum 40 comprises an electrically conductive plastic drum. The use of CGL 43, which layer is dispersion coated from a coating ink that includes non-amine solvents, protects the plastic of the drum from attack by highly active solvents, such as amines.

FIG. 6 demonstrates the critical ranges of ester content of the invention and the effects that the ester content produces in relation to the photoconductor's CTL. All seven of the photoconductor samples, identified in column 1 of FIG. 6 as samples A–G, had a CTL comprising 40 wt. % DEH and 60 wt. % polymeric binder. The CGL of these samples comprised an amine coated OHSQ layer.

Note that the CTL polymeric binder of samples A and G contained zero percent ester content and 100% ester content, respectively.

Samples B–F had a CTL polymer comprising the ordered copolyestercarbonate described above whose ester content spanned the range of about 35 to 90 wt. %. As will be shown, samples B–E are samples within the teaching of the invention (having an ester content in the range of about 35 to 70 wt. %), samples D and E are the preferred samples of the invention (having an ester content in the range of about 60 to 70 wt. %), and the most preferred is sample F (having an ester content of 70 wt. %).

FIG. 6 shows in columns 3 and 4 thereof the photoconductor charge voltage and the discharge voltage, respectively, of the photoconductor samples when the photoconductor had experienced no prior room or blue light fatigue, and no prior cycling or yellow light fatigue.

All samples were subjected to the same charge source to produce columns 3, 5 and 7. Columns 4, 6 and 8 were produced by erasing the charged photoconductor samples of columns 3, 5 and 7, respectively, using a laser light source of about 0.4 micro joules per square centimeter.

Column 3 shows the magnitude of the charge that the photoconductor samples accepted as they passed through the charging station. All samples were then subjected to the same intensity imaging station, and column 4 shows the voltage level to which the sample was discharged as it passed through the imaging station.

For example (see columns 3 and 4), sample D (63 wt. % ester content) accepted an initial charge of 672 volts and was subsequently discharged to 109 volts by operation of the imaging station, and sample E (69 wt. % ester content) accepted an initial charge of 669 volts and was subsequently discharged to 104 volts by operation of the imaging station.

Columns 5 and 6 of this table show the photoconductor charge voltage and the discharge voltage, respectively, of the samples after having been exposed to thirty minutes of room light fatigue in the form of a cool white fluorescent light of an intensity of about 136 micro watts.

For example (see columns 5 and 6), sample D accepted a charge of 650 volts after experiencing room light fatigue and was subsequently discharged to 44 volts at the imaging station, whereas sample E accepted a charge of 646 volts after experiencing room light fatigue and was subsequently discharged to 36 volts at the imaging station.

Note that the above-mentioned change that was experienced by samples D and E is typical of all samples. That is, both the fatigued charge state (column 5) and the fatigued discharge state (column 6) reduce in magnitude as compared to columns 3 and 4. This reduction tends to be of a generally equal magnitude for both the column 3–4 condition and the column 5–6 condition, so that the development vector remains approximately the same magnitude before and after fatigue. While not shown in FIG. 6, after a period of rest, all samples tend to return from their column 5–6 state to their column 3–4 state (i.e., a period of rest cures the sample of its room light fatigue).

Columns 7 and 8 of FIG. 6 show the charge and discharge states, respectively, of the same photoconductor samples after having been cycled through 40,000 cycles of a portion of a process that duplicated the effect of the yellow erase lights (i.e. columns 7 and 8 show the effect of yellow light fatigue). Again noting samples D and E (i.e., an ester content in the range of about 60 to 70 wt. %), sample D accepted a charge of 619 volts and was discharged to 213 volts, whereas sample E accepted a charge of 604 volts and was discharged to 179 volts.

As will be appreciated by those of skill in the art, an analysis of FIG. 6 enables one to eliminate certain samples as viable photoconductor candidates.

Considering sample A of FIG. 6 (i.e., the zero percent ester content sample) it can be seen that this sample is unacceptable in that after being subjected to room light fatigue (columns 5 and 6), the sample's white charge voltage was an unusable high 230 volts (see curve 28 of FIG. 2, for example).

Considering sample G of FIG. 6 (i.e., the 100% ester content sample), it can be seen that this sample is unacceptable in that after being subjected to room light fatigue (column 5), the sample's dark charge voltage was an unusable low 448 volts (see curve 20 of FIG. 2, for example).

While samples B and C of FIG. 6 are usable in a reproduction device, they have some undesirable characteristics.

Sample B has an unusually high discharge voltage of 237 volts (column 8), and this may result in poor image quality after an extended period of usage. Note that for this sample the initial development vector is 546 volts (678 minus 132), but that the magnitude of this vector drops to 388 volts (625 minus 237) after 40K cycles of yellow light exposure.

Sample C not only has a similar usage fatigue characteristic but, additionally, this sample has the highest of all initial discharge voltage values (column 4) and its discharge voltage after room light fatigue (column 6) is quite high, as was above mentioned relative sample A.

Sample F is subject to the same comment as sample B, but its main fault, rendering the sample not within the invention, appears as a result of cycling under yellow light exposure (columns 7 and 8).

Samples B–E are within the invention. Of these, samples D and E are the preferred examples of the invention and, of these, sample E is the most preferred. In samples B–E, the charge voltage is uniformly high (columns 3, 5 and 7), the discharge voltage is uniformly of a usable low level (columns 4, 6 and 8) and while the development vector changes in magnitude with both room light and yellow light fatigue, these changes in magnitude are manageable in a reproduction device.

Thus, from FIG. 6 it is determined that the ester content of the ordered copolyestercarbonate binder of the CTL within the invention is in the range of about 35 to 70 wt. % (samples B–E), and preferably is at the high end of this range, at about 60 to 70 wt. % (samples D and E), and most preferably at about 70 wt. % (sample E).

As mentioned previously, an advantage of the present invention is that squarylium CGL coating dispersions that do not contain corrosive amine solvents may be prepared, thus providing a chemically stable coating ink and a cost-effective coating process. Prior to the present invention, it was necessary to solubilize the insoluble OHSQ by combining it with with an amine to form a colorless soluble complex. This solution was then mixed with a binder polymer and solvent to form the CGL coating ink. In this prior art arrangement, corrosion containment was required due to the chemical activity of the amines.

The present invention disperses the insoluble squarylium in a solvent/polymer matrix of the above-mentioned ordered copolyestercarbonate having an ester content in the range of about 35 to 70 wt. %. and preferably at the high end of this range; for example, about 70 wt. %. This produces a fine particle coating dispersion of substantial viscosity and low chemical activity. The high viscosity of this coating dispersion is an advantage in that the coating process working window is increased in size. Because the coating ink is chemically inactive, it may be stored for up to two weeks prior to coating use. In addition, the photoconductor's dispersion coated CGL exhibits greater resistance to the solvents that are contained in the subsequently coated CTL.

Figure 7:
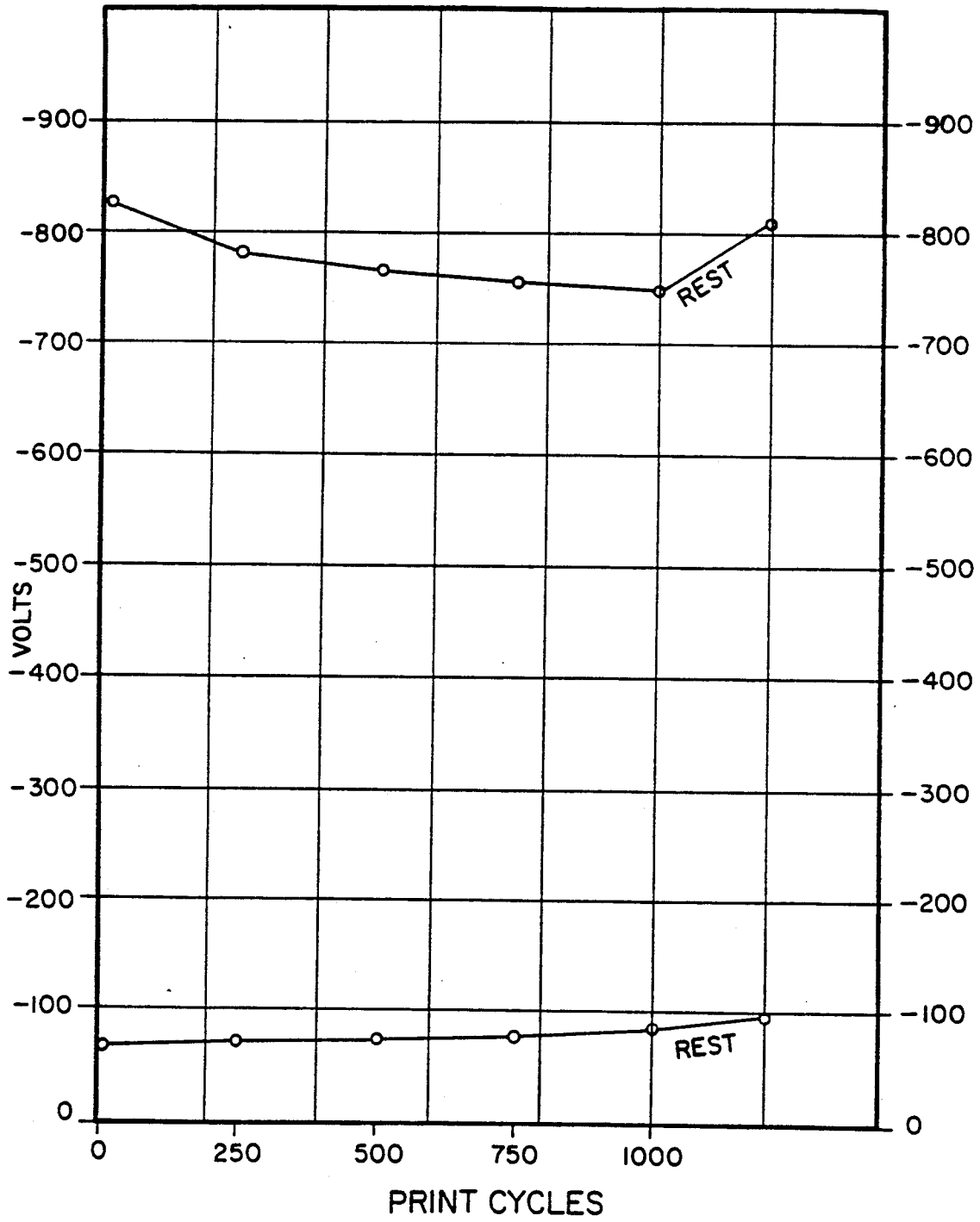
FIG. 7 shows the dark charge and white charge characteristics of a photoconductor drum having a CGL in accordance with the invention.

FIG. 7 shows the dark charge curve 50 and the white charge curve 51 (similar to 20 and 22 of FIG. 2) for a photoconductor drum of the type shown in FIG. 4. The CGL of this drum was about 0.1 to 0.2 microns thick, and the CTL was of the above-mentioned type containing the ordered copolyestercarbonate of the invention. Since charging and sensitivity of a photoconductor using this CGL is directly related to the amount of squarylium dye present, the polymer-to-dye ratio must be carefully controlled in the above-given exemplary CGL coating ink formulation.

As can be seen from FIG. 7, the photoconductor drum exhibited excellent dark fatigue and light fatigue characteristics.

The present invention has been described with reference to various embodiments thereof. However, the scope and content of the invention is to be limited only by the following claims.

What is claimed is:

1. An electrophotographic photoconductor having reduced discharged-area fatigue and reduced fatigue upon exposure to room light, comprising:

a ground plane member, a charge generating layer carried by said ground plane member, said charge generating layer including a squarylium charge generating material capable of generating hole/electron pairs in the presence of activating radiation, and a charge transport layer carried by said charge generating layer, said charge transport layer including a hydrazone material capable of transporting generated holes from said charge generating layer to the exposed surface of said charge transport layer, said charge generation layer and said charge transport layer including a polymeric binder material comprising an ordered copolyestercarbonate whose ester content is in the range of about 35 to 70 wt. %.

2. An electrophotographic photoconductor in accordance with claim 1 wherein said charge transport material is DEH.

3. An electrophotographic photoconductor in accordance with claim 1 wherein said charge generation material is OHSQ.

4. An electrophotographic photoconductor in accordance with claim 1 wherein said charge transport material is DEH, and said charge generation material is OHSQ.

5. An electrophotographic photoconductor in accordance with claim 4 wherein said charge generation layer and said charge transport layer including a polymeric binder material comprising an ordered copolyestercarbonate whose ester content is in the range of about 60 to 70 wt. %.

6. An electrophotographic photoconductor in accordance with claim 5 wherein said polymeric binder material comprises an ordered copolyestercarbonate whose ester content is about 70 wt. %.

7. An electrophotographic photoconductor, comprising:

a charge generating layer having a charge generating material in a polymeric binder, said charge generating material being capable of generating hole/electron pairs in the presence of activating radiation, and a charge transport layer carried by said charge generating layer, said charge transport layer comprising a hydrazone material capable of transporting generated holes from said charge generating layer to the exposed surface of said charge transport layer, and an ordered copolyestercarbonate whose ester content is in the range of about 35 to 70 wt. %.

8. An electrophotographic photoconductor in accordance with claim 7 wherein said charge transport material is DEH.

9. An electrophotographic photoconductor in accordance with claim 8 wherein said ordered copolyestercarbonate has an ester content in the range of about 60 to 70 wt. %.

10. An electrophotographic photoconductor in accordance with claim 9 wherein said ordered copolyestercarbonate has an ester content of about 70 wt. %.

11. An electrophotographic photoconductor in accordance with claim 10 including a ground plane member on which said charge generating layer is located.

12. An electrophotographic photoconductor in accordance with claim 7 wherein said charge transport material is 2-methyl-4-diethylaminobenzaldehyde,1,1-diphenylhydrazone.

13. An electrophotographic photoconductor, comprising:

a charge generating layer comprising a squarylium material capable of generating hole/electron pairs in the presence of activating radiation, and an ordered copolyestercarbonate whose ester content is in the range of about 35 to 70 wt. %, and a charge transport layer carried by said charge generating layer, said charge transport layer having a charge transport material in a polymeric binder.

14. An electrophotographic photoconductor in accordance with claim 13 wherein said charge generating material is OHSQ.

15. An electrophotographic photoconductor in accordance with claim 14 including a ground plane member on which said charge generating layer is located.

16. An electrophotographic photoconductor in accordance with claim 15 wherein said ordered copolyestercarbonate has an ester content in the range of about 60 to 70 wt. %.

17. An electrophotographic photoconductor in accordance with claim 16 wherein said ordered copolyestercarbonate has an ester content of about 70 wt. %.

18. A method of making a layered electrophotographic photoconductor having reduced discharged-area fatigue and reduced fatigue upon exposure to room light, comprising:

providing a ground plane member, mixing an ordered copolyestercarbonate whose ester content is in the range of about 35 to 70 wt. % in a first solvent to form a first solution, mixing a squarylium charge generating material in said first solution to form a coating dispersion in the absence of amines, coating said coating dispersion on said ground plane member to form a charge generating layer on said ground plane member, and subsequently processing said charge generation layer to drive off said first solvent, mixing an ordered copolyestercarbonate whose ester content is in the range of about 35 to 70 wt. % in a second solvent to form a second solution, mixing a hydrazone charge transport material in said second solution to form a coating solution, and coating said coating solution on said charge generating layer to form a charge transport layer on said charge generating layer, and subsequently processing said charge transport layer to drive off said second solvent.

19. A method of making a layered electrophotographic photoconductor in accordance with claim 18 wherein said hydrazone charge transport material is DEH.

20. A method of making a layered electrophotographic photoconductor in accordance with claim 18 wherein said squarylium charge generation material is OHSQ.

21. A method of making a layered electrophotographic photoconductor in accordance with claim 18 wherein said hydrazone charge transport material is DEH, and said squarylium charge generation material is OHSQ.

22. A method of making a layered electrophotographic photoconductor in accordance with claim 21 wherein the ester content of the ordered copolyestercarbonate of said first and second solutions is in the range of about 60 to about 70 wt. %.

23. A method of making a layered electrophotographic photoconductor in accordance with claim 22 wherein the ester content of the ordered copolyestercarbonate of said first and second solutions is about 70 wt. %.

24. A method of making a layered electrophotographic photoconductor in accordance with claim 23 wherein said first and second solvents are THF.

25. A drum shaped electrophotographic photoconductor for use in an electrophotographic reproduction device, comprising:

an aluminum drum, a polyamide barrier layer coated on the exterior aluminum surface of said drum, a polymeric subbing layer coated on said barrier layer, a squarylium-containing, dispersion-coated, CGL coated on said subbing layer, said CGL including an ordered copolyestercarbonate having an ester content in the range of about 35 to about 70 wt. % as a binder, and a hydrazone-containing, solution-coated, CTL coated on said CGL, said CTL including said ordered copolyestercarbonate as a binder.

26. A drum shaped electrophotographic photoconductor in accordance with claim 25 wherein said subbing layer comprises said ordered copolyestercarbonate.

27. A drum shaped electrophotographic photoconductor in accordance with claim 26 wherein said ordered copolyestercarbonate has an ester content in the range of about 60 wt. % to about 70 wt. %.

28. A drum shaped electrophotographic photoconductor in accordance with claim 27 wherein said ordered copolyestercarbonate has an ester content of 70 wt. %.

29. An electrophotographic photoconductor comprising:

a ground plane member, a charge generation layer carried by said ground plane member, said charge generation layer including an operative phthalocyanine charge generation material capable of generating hole/electron pairs in the presence of activating radiation, and a polymeric binder material comprising an ordered copolyestercarbonate whose ester content is in the range of about 35 to 70 wt. %, and a charge transport layer carried by said charge generation layer and including a material capable of transporting generated holes from said charge generating layer to the exposed surface of said charge transport layer.

30. An electrophotographic photoconductor in accordance with claim 29 wherein said ester content is in the range of about 60 to 70 wt. %.

31. An electrophotographic photoconductor in accordance with claim 29 wherein said ester content is about 70 wt. %.

32. An electrophotographic photoconductor in accordance with claim 29 wherein said charge generation material is an oxytitanium phthalocyanine.

33. An electrophotographic photoconductor in accordance with claim 30 wherein said charge generation material is an oxytitanium phthalocyanine.

34. An electrophotographic photoconductor in accordance with claim 31 wherein said charge generation material is an oxytitanium phthalocyanine.

35. An electrophotographic photoconductor comprising:

a ground plane member, a charge generation layer carried by said ground plane member, said charge generation layer including a charge generation material capable of generating hole/electron pairs in the presence of activating radiation, and a charge transport layer carried by said charge generation layer and including a TPH material capable of transporting generated holes from said charge generating layer to the exposed surface of said charge transport layer and a polymeric binder material comprising an ordered copolyestercarbonate whose ester content is in the range of about 35 to 70 wt. %.

36. An electrophotographic photoconductor in accordance with claim 35 wherein said ester content is in the range of about 60 to 70 wt. %.

37. An electrophotographic photoconductor in accordance with claim 35 wherein said ester content is about 70 wt. %.

38. An electrophotographic photoconductor comprising:

a ground plane member, a charge generation layer carried by said ground plane member, said charge generation layer including an oxytitanium phthalocyanine charge generation material capable of generating hole/electron pairs in the presence of activating radiation, and a polymeric binder material comprising an ordered copolyestercarbonate whose ester content is in the range of about 35 to 70 wt. %, and a charge transport layer carried by said charge generation layer and including a TPH material capable of transporting generated holes from said charge generating layer to the exposed surface of said charge transport layer and a polymeric binder material comprising an ordered copolyestercarbonate whose ester content is in the range of about 35 to 70 wt. %.

39. An electrophotographic photoconductor in accordance with claim 38 wherein said ester content of said charge generation layer and said charge transport layer is in the range of about 60 to 70 wt. %.

40. An electrophotographic photoconductor in accordance with claim 38 wherein said ester content of said charge generation layer and said charge transport layer is about 70 wt. %.

* * * * *